US005143297A

United States Patent [19]

De Michele et al.

[11] Patent Number: 5,143,297

[45] Date of Patent: Sep. 1, 1992

[54] ATOMIZER FOR VISCOUS LIQUID FUELS

[75] Inventors: Gennaro De Michele, Pisa; Mario Graziadio, Pontedera, both of Italy

[73] Assignee: Ente Nazionale Per L'Energia Electrica, Rome, Italy

[21] Appl. No.: 673,718

[22] Filed: Mar. 22, 1991

[30] Foreign Application Priority Data

Mar. 26, 1990 [IT] Italy ..... 9352 A/90

[51] Int. Cl.[5] ..... B05B 7/04

[52] U.S. Cl. ..... 239/427; 239/430; 239/433

[58] Field of Search ..... 239/427, 429, 430, 433, 239/558

[56] References Cited

U.S. PATENT DOCUMENTS 4,708,293 11/1987 Graziadio et al. ..... 239/427
4,846,402 7/1989 Sandell et al. ..... 239/429
4,890,793 1/1990 Füglistaller et al. ..... 239/427

FOREIGN PATENT DOCUMENTS 0253041 1/1988 European Pat. Off. .
0278115 8/1988 European Pat. Off. .
2212497 7/1974 France .

*Primary Examiner*—Andres Kashnikow
*Assistant Examiner*—Lesley D. Morris
*Attorney, Agent, or Firm*—Browdy and Neimark

[57] ABSTRACT

Atomizer for viscous fuels formed by a first and a second mixing chamber arranged along a common longitudinal axis, the second chamber being formed by a cylindrical portion and two consecutive frustoconical portions on the conical walls of which two rows of orifices are placed for the inlet for the atomized fuel into the combustion chamber. The orifices are arranged according to two circumferences and have axes orthogonal to the conical walls on which they are placed, axes which meet inside the second mixing chamber at a point on the longitudinal axis. The orifices are equally angularly spaced and radially aligned. The angle between the axes of two orifices symmetrical with respect to the longitudinal axis of the outer row is comprised between 80° and 120°, while the difference between this angle and the corresponding angle formed by the axes of the two symmetrical orifices of the inner row is not less than 20°.

6 Claims, 1 Drawing Sheet

ATOMIZER FOR VISCOUS LIQUID FUELS

DESCRIPTION

1. Field of the Invention

The present invention relates to an improved atomizer for viscous liquid fuels. More particularly, the invention relates to an atomizer suited for installation on burners for high viscosity liquid fuels or for two-phase fuel mixtures such as carbon-fuel oil or carbon-water, themselves also of high viscosity and, in both cases, in the presence of an atomizing fluid such as air or vapor.

2. Description of the prior art

An atomizer of a type known for applications such as the above mentioned is formed by two coaxial mixers in series each comprising its own mixing chamber. The mixing chamber of the first mixer is substantially a cylindrical duct with two inlets, an axial one for the fuel and the lateral one for the atomizing fluid. This mixing chamber directly communicates with the mixing chamber of the second mixer which has a larger diameter than the former and ends with a frustoconical portion on which is placed a row of outlet orifices for the atomizing fuel, said orifices being arranged along a circumference and with axes perpendicular to the conical wall of the second mixing chamber and all convergent at an internally situated point in the chamber, along the longitudinal axis of the atomizer. Thanks to the particular relations existing between the dimensions of the various parts of the above described atomizer, an optimum atomization of the fuel injected into the firebox is obtained. An atomizer such as that described above is described in U.S. Pat. No. 4,708,293 in the name of the same applicant.

Control of the production of nitrogen oxide in this as in other types of known atomizers is not however considered optima.

It was in regard to this that the importance of the interference of the various jets of atomized fuel injected into the firebox upon increase in nitrogen oxide production was pointed out. The jets, in fact, interfering with each other, create a single significant flame which has a radiation surface reduced in comparison to its own volume, with consequent increase of the flame temperature and parallel increase of the nitrogen oxides produced.

In order to limit this inconvenience, a particular arrangement of the injection orifices of the atomized fuel into the combustion chamber has been proposed which, preventing the interference among the jets, produces many small separate flames increasing considerably the irradiation surface with respect to the total volume of the flame with reduction of the temperature of the flame and consequent decreased production of nitrogen oxides. In particular, the angle formed by the injection axes of the orifices with the longitudinal axis of the atomizer increases with the distance of the orifices from said longitudinal axis and also the orifices can be arranged on more circular concentric rows equally angularly spaced along each row but staggered radially between adjacent rows, such that the combustion of each jet occurs complete independently of the nearby jets.

The general object of this invention is that of eliminating, or at least limiting, the production of nitrogen oxides in the combustion process of viscous liquid fuels injected by way of atomizers of a traditional type.

A particular object of this invention is to provide an atomizer for viscous liquid fuels of the type mentioned above in which, with a particular arrangement of atomized fuel injection orifices in the combustion chamber a better control over the production of nitrogen oxides can be obtained with respect to that which up to now has been realized.

SUMMARY OF THE INVENTION

The atomizer according to this invention is of the double mixing chamber type, as described above, and is based on the fact the atomized fuel is divided into two concentric areas, of which the outer area contacts the combustion air and burns substracting oxygen from the inner area in which, exactly for the oxygen deficiency, the production of nitrogen oxides is decreased. In practical terms, the two areas are each composed of the intersection of various jets of fuel each originating from an outlet orifice of the atomizer.

To obtain said result, in the atomizer according to this invention, the fuel injection orifices provided for on the walls of the second mixing chamber are arranged along two concentric rows which are angularly equally spaced on each row and radially aligned. The axis of the orifices intersect the longitudinal axes of the atomizer at a common point inside the second mixing chamber. Also the difference between angles formed by two pairs of radially aligned orifices belonging to the one and the other row respectively being no smaller than 20°.

In this way, the jets coming from the adjacent and radially aligned orifices are well separated from one another, thus the outer one can burn completely and substract more oxygen from the internal orifice.

BRIEF DESCRIPTION OF THE DRAWINGS

Other characteristics and advantages of the atomizer for viscous liquid fuels according to this invention will be clarified in the following description of one of its possible embodiments given as an example but not limitative, with reference to the attached drawings in which.

DESCRIPTION OF THE PREFERRED EMBODIMENT

Figure 1:
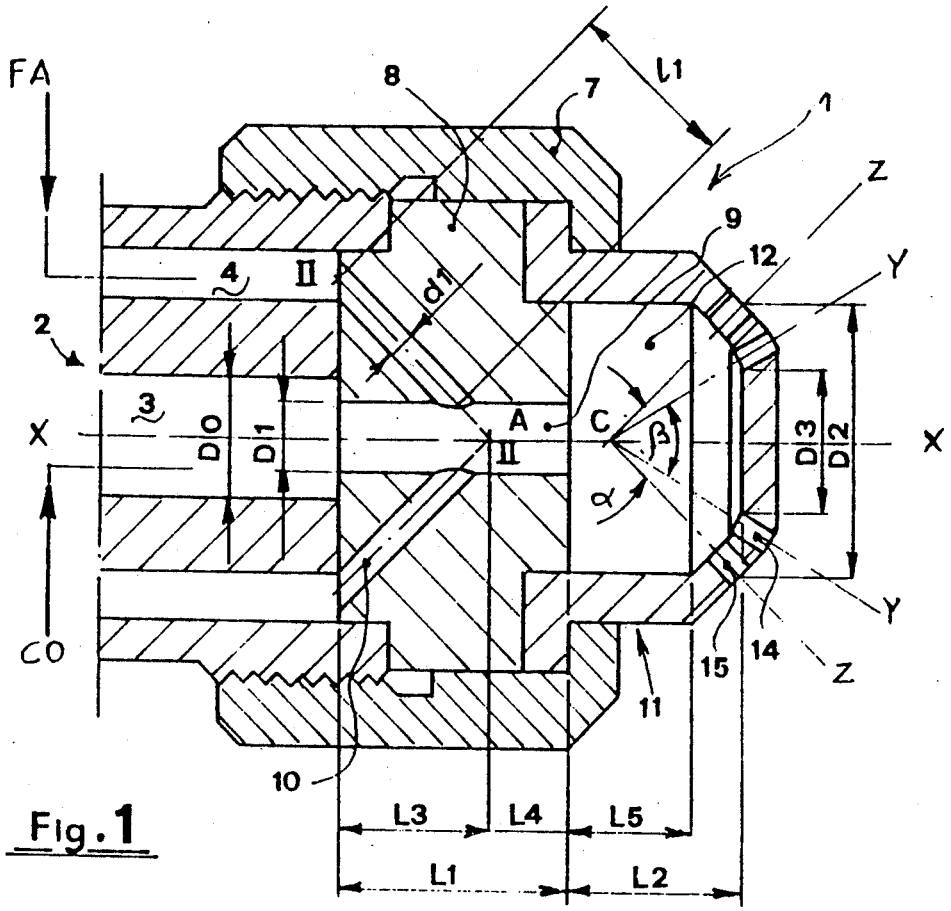
FIG. 1 is a cross sectional view of the atomizer according to this invention.
Figure 2:
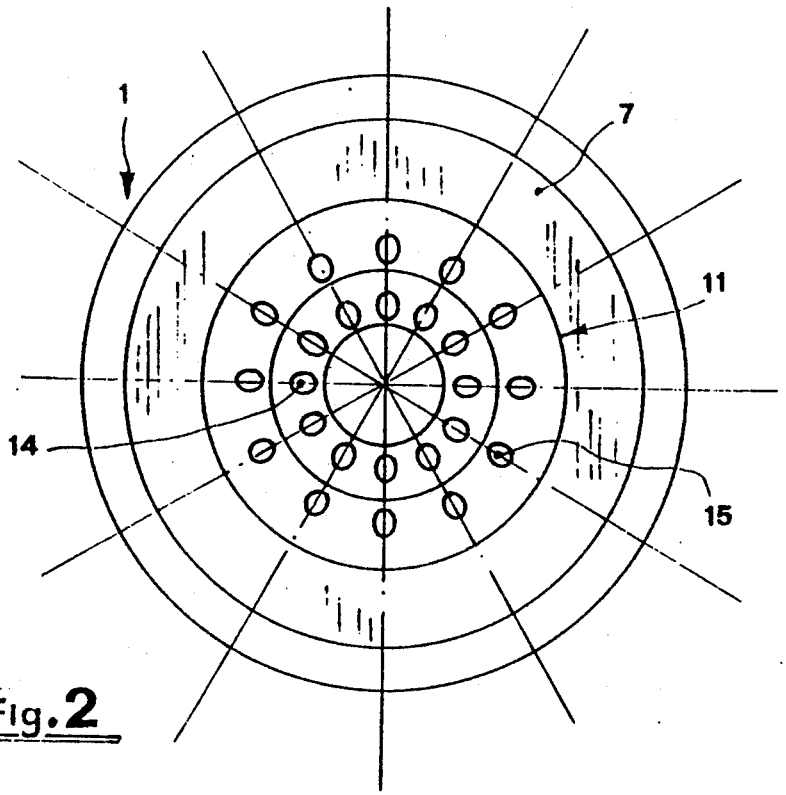
FIG. 2 is a front view of the atomizer of FIG. 1.

With reference to the above mentioned figures, 1 indicates the atomizer according to this invention which comprises a supply section 2 for the liquid fuel and atomizing fluid formed substantially by a central tubular duct 3 for the fuel CO and by a lateral tubular duct 4 concentric with the former for the atomizing fluid FA, generally air. The atomizer also comprises a first mixer 8, downstream of the supply section, in which there is placed a mixing chamber 9 of a tubular form axially aligned with the central duct 3 along the longitudinal axis of the atomizer, indicated with X-X. The mixing chamber 9 communicates with the atomizing fluid 4 through a plurality of channels 10 formed in the body of the first mixer 8 and convergent towards a common point on the longitudinal axis of the atomizer inside chamber 9.

The atomizer also comprises a second mixer 11 downstream of the first mixer 8 along the longitudinal axis of the atomizer, which delimits a second mixing chamber 12 communicating directly with the first mixing chamber 9 with which it is coaxial. The first mixer 8 and the second mixer 11 are both connected to the supply chamber 2 by means of a threaded locking ring 7 which is engaged on a corresponding threaded portion formed on the outer surface of the atomizing fluid duct 4.

According to this invention, the second mixing chamber 12 is formed by a cylindrical portion and by two consecutive coaxial frustoconical portions, on the conical surface of which there are placed two circular rows of orifices 14 and 15 for the inlet of the completely atomized fuel into the combustion chamber. On each row the orifices 14 and 15 are angularly equally spaced while the orifices of the rows are aligned radially two by two. The axes Y and Z respectively of the orifices 14 and 15 all meet at the same point C inside the second mixing chamber 12 and on the longitudinal X-X axis of the atomizer.

The relations between the characteristic dimensions of the various components of the atomizer according to this invention are those already indicated in the cited U.S. Pat. No. 4,708,293. In particular, being $D_0$=diameter of central duct 3

$D_1$, $L_1$=diameter/length first mixing chamber 9

$D_2$, $L_2$=cylindrical portion diameter/overall length of reference number 12

$D_3$, $L_5$=of the end wall diameter/length cylindrical portion of second mixing chamber 12, the following relations are still valid:

$L_5/D_2>0.6$ $0.6\times D_2<L_2<1.2\times D_2$ $D_2>3\times D_1$ $D_3>D_1$

Also, according to the invention, the angle $\alpha$ formed between two Z axes of two orifices 15 symmetric with respect to the longitudinal X-X axis of the atomizer is comprised between 80° and 120°, while the angle $\beta$ comprised between the Y axes of the two orifices 14 symmetric with respect to a common longitudinal axis, is such that $\alpha-\beta\geqq 20°$ This last condition assures that the jets of atomized fuel in the combustion chamber are well separated from one another.

The orifices 14 and 15 are cylindrical and their Y and Z axes are perpendicular to the respective conical surfaces of the second mixer 11. The diameter and the length of the orifices 14 arranged along the inner row can be different from those of the orifices 15 of the outer row, while on each of the two rows the orifices must all be equal to each other. In particular, d and l being the diameter and length of the orifices 14 or 15, the following relation must apply $$d<l<3\times d$$

Naturally, the number of orifices 14 forming the inner row must be equal to the number of orifices 15 forming the outer row and there must be an angular correspondence between orifices 14 and orifices 15. This geometric condition is considered very important for the attainment of the optima combustion conditions. Between the total cross sectional areas of orifices 14 and 15 and the cross sectional area of the first mixing chamber 9 the relation $$S<n_1\times s_1+S_1$$

must exist where $n_1$ and $s_1$ are the number and the cross sectional area of the adduction channels 10 of the atomizing fluid.

Finally, as in the above cited U.S. patent, the number of orifices of each row must be greater than 3.

Variations and/or modifications can be brought to the improved atomizer for viscous liquid fuels according to this invention, without departing from the scope of the invention itself.

We claim:

1. Improved atomizer for viscous liquid fuels for use with a combustion chamber comprising a first mixer and a second mixer for mixing the fuel with an atomizing fluid supplied respectively by a central inlet and side inlets, said first mixer comprising a first mixing chamber into which said fuel and said fluid are fed respectively through said central and side inlets, said second mixer comprising a second mixing chamber aligned with said first mixing chamber along a longitudinal axis, to which premixed fuel and atomizing fluid are fed, and a plurality of outlets to inject the atomized fuel into the combustion chamber, said atomizer being characterized by the fact that said plurality of outlets from said second mixing chamber is formed by two rows of orifices arranged according to two concentric circumferences angularly equidistanced and radially aligned, axes of said orifices converging in a common point located inside said second mixing chamber along said longitudinal axis, the angles $\alpha$ and $\beta$ formed by said axes of two orifices symmetrical with respect to the longitudinal axis and belonging to said inner and outer circumferences respectively being such that $\alpha-\beta\geqq 20°$.

2. Atomizer according to claim 1, wherein angle $\alpha$ formed by said axes of two orifices symmetrical with respect to said longitudinal axis and belonging to said outer circumference is comprised between 80° and 120°.

3. Atomizer according to claim 1, wherein said second mixing chamber is formed by a cylindrical portion with an axis coinciding with said longitudinal portion with an axis coinciding with said longitudinal axis and from two successive frustoconical portions coaxial with said cylindrical portion, said orifices being placed on conical walls delimitating said frustonical portions, said axes of said orifices being perpendicular to the respective walls on which they are placed.

4. Atomizer according to claim 3, wherein along each of said conical walls a row of said orifices is placed.

5. Atomizer according to claim 1, wherein the number of orifices placed on one of said conical walls is equal to the number of orifices placed on the other.

6. Atomizer according to claim 1, wherein said orifices have cross-sections whose total area is less than the total area of the cross-sections of said first mixing chamber and said side inlets for the atomizing fluid to said first mixing chamber.

* * * * *